US007681870B2

(12) United States Patent
Ben-Gigi

(10) Patent No.: US 7,681,870 B2
(45) Date of Patent: Mar. 23, 2010

(54) PIPE CLAMP FIXTURE

(75) Inventor: Zion Ben-Gigi, Kfar Veradim (IL)

(73) Assignee: Tefentools Ltd., Tefen (IL)

( * ) Notice: Subject to any disclaimer, the term of this patent is extended or adjusted under 35 U.S.C. 154(b) by 0 days.

(21) Appl. No.: 11/617,741

(22) Filed: Dec. 29, 2006

(65) Prior Publication Data

US 2007/0152392 A1 Jul. 5, 2007

(51) Int. Cl.
*B25B 1/00* (2006.01)

(52) U.S. Cl. ..... 269/6; 269/3; 269/86

(58) Field of Classification Search ..... 269/6, 269/166–171.5, 197–199, 95, 147; 285/148.23, 285/148.22, 332.4, 333; 411/432, 436, 437
See application file for complete search history.

(56) References Cited

U.S. PATENT DOCUMENTS 1,187,109 A * 6/1916 Steuernagel ..... 269/204
2,468,358 A * 4/1949 Clark ..... 269/45
3,480,152 A * 11/1969 Walsh ..... 211/74
3,499,206 A * 3/1970 Quernheim ..... 29/239
4,712,812 A * 12/1987 Weir, III ..... 285/148.23
5,058,869 A * 10/1991 Ruthven ..... 269/45

* cited by examiner

*Primary Examiner*—Lee D Wilson
(74) *Attorney, Agent, or Firm*—Dekel Patent Ltd.; David Klein

(57) ABSTRACT

A pipe clamp fixture that may be used for more than one size diameter pipe is described.

5 Claims, 3 Drawing Sheets

PIPE CLAMP FIXTURE

FIELD OF THE INVENTION

The present invention relates generally to clamp fixtures, and particularly to a multi-size pipe clamp fixture.

BACKGROUND OF THE INVENTION

Bar clamps are used in carpentry and handicraft applications. They generally comprise a pair of jaws that slide along a bar. Pipe clamp fixtures are used to build bar clamps. Generally pipes are used to enable one to tailor make the desired length of the clamps. This may be important to the end user, as the work piece may be longer than the standard clamps sold. In addition, the available space for working may be limited.

The sizes of the pipes are standard, generally ½ or ¾", although there could be any other standard size such as ¼" or ⅞". For each pipe size (diameter), there tends to be a different fixture. Accordingly, the consumer who may wish to work with different pipe sizes would need to own fixtures of each size. This may be cumbersome when one considers that usually one has at least 4-6 sets of pipe clamps. Retail stores need to sell fixtures of each size.

SUMMARY OF THE INVENTION

The present invention seeks to provide a novel pipe clamp fixture adapted for use with a multiplicity of pipe sizes, as is described more in detail hereinbelow.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
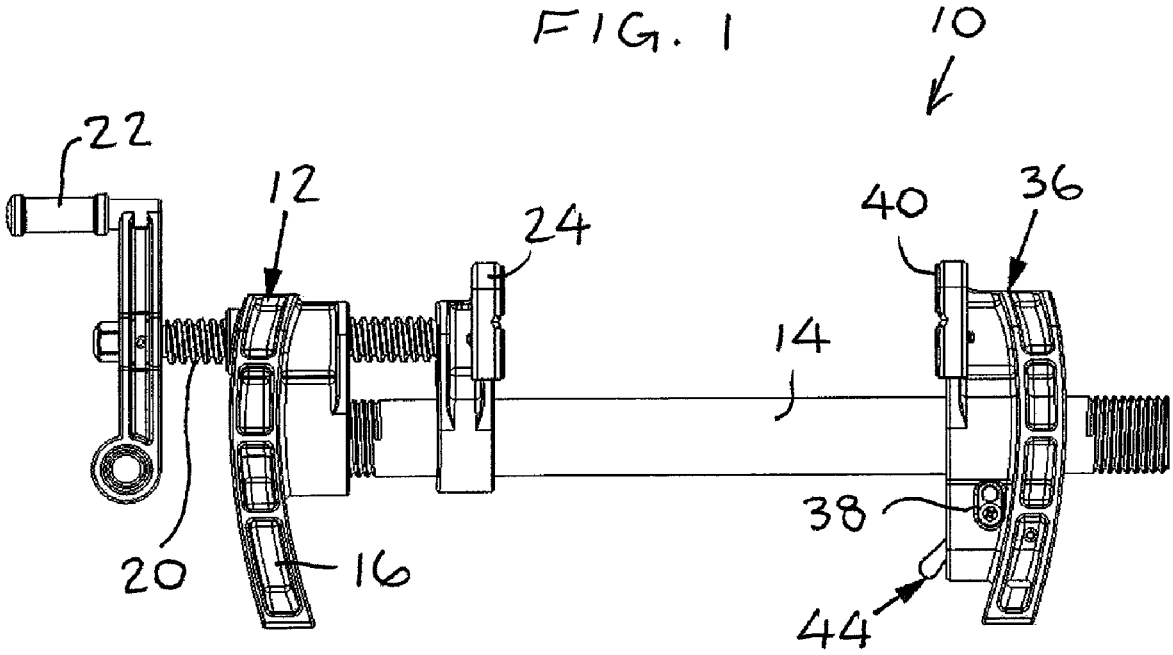
FIG. 1 is a simplified pictorial illustration of a pipe clamp fixture, constructed and operative in accordance with an embodiment of the present invention, using a pipe of a first diameter (e.g., ¾ inch), showing the movable head with a diameter selection lever (in the lower position) and the stationary head with a pipe mounting hole (in the lower position)
Figure 2:
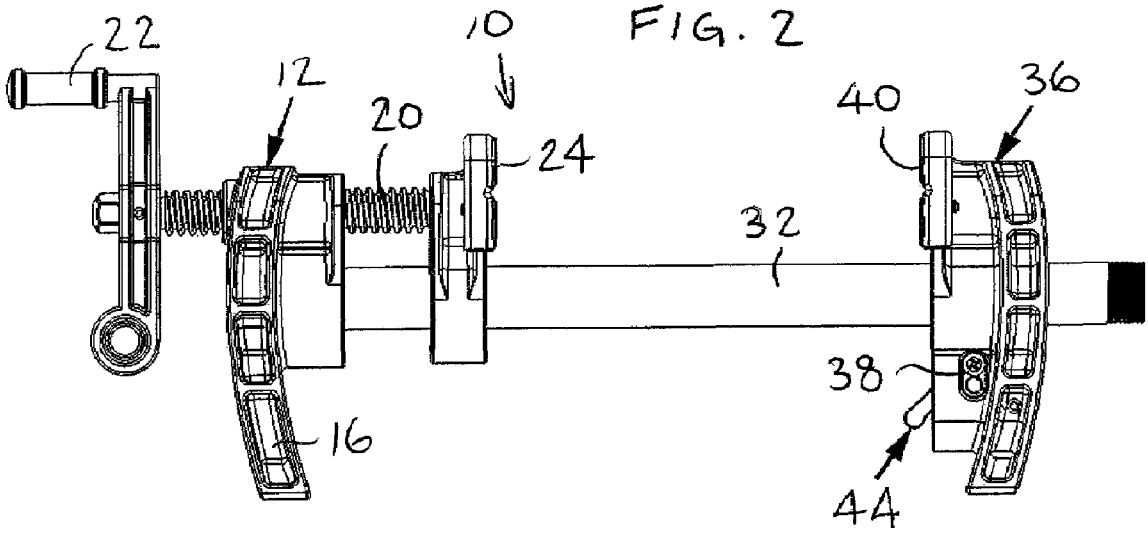
FIG. 2 is a simplified pictorial illustration of the pipe clamp fixture of FIG. 1, showing the tool ready for operation with another size pipe (e.g., ½ inch), with the diameter selection lever in its upper position and the pipe mounted in a different pipe mounting hole.
Figure 3:
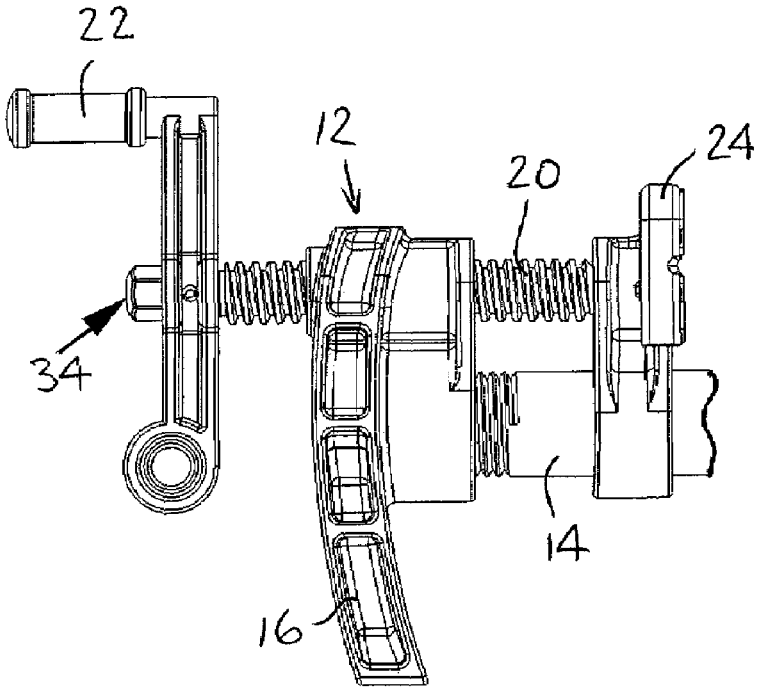
FIG. 3 is a simplified pictorial illustration of the stationary head of the pipe clamp fixture of FIG. 1, showing a hex bolt for achieving extra force, in accordance with an embodiment of the present invention.
Figure 4:
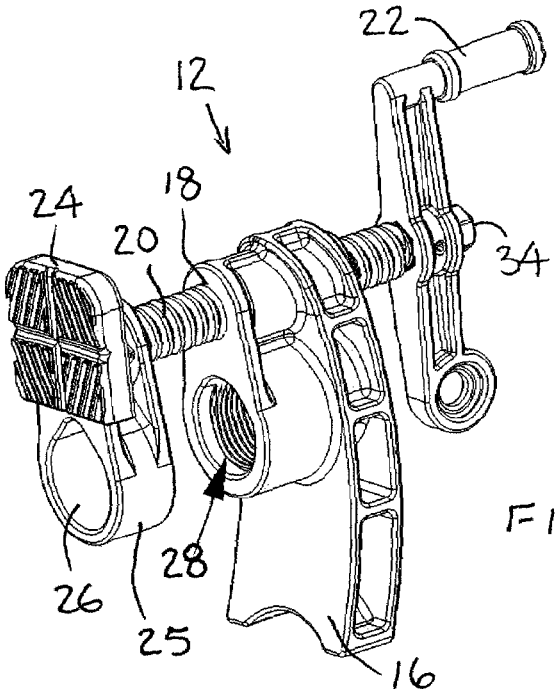
FIGS. 4 and 5 are simplified pictorial illustrations of the stationary head of the pipe clamp fixture of FIG. 1, showing the possibility of large and small pipe threads in the stationary head, respectively.
Figure 5:
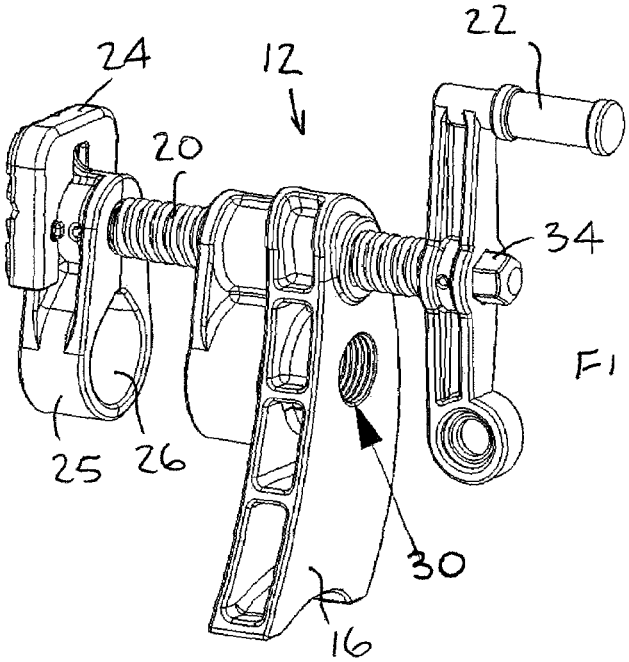

Reference is made to FIGS. 1-5, which illustrate a pipe clamp fixture 10, constructed and operative in accordance with an embodiment of the present invention.

Pipe clamp fixture 10 may include a stationary head 12 that may be affixed to a pipe 14. Stationary head 12 may include a bulkhead 16 (FIG. 4) at the top of which is a threaded hole 18 for a threaded rod 20 to pass through. A handle 22 may be affixed to one end of rod 20 and a clamping jaw 24 may be affixed to the other end. Clamping jaw 24 may be affixed to a bracket 25 with a support hole 26 for supporting pipe 14. The bulkhead 16 of stationary head 12 may include more than one mounting hole for pipe 14. For example, stationary head 12 may include a first mounting hole 28 (FIG. 4) on one side thereof, e.g., a female threaded hole for accepting a ¾ inch diameter, male-threaded pipe 14. Stationary head 12 may include a second mounting hole 30 (FIG. 5) on another side thereof of a different diameter than the first mounting hole, e.g., a female threaded hole for accepting a ½ inch diameter, male-threaded pipe 32.

Stationary head 12 may be manually turned (tightened or loosened) by means of handle 22. Additionally or alternatively, stationary head 12 may include a power drive connection 34, such as a hexagonal nut at the end of rod 20 for turning with a power or hand tool, for example.

Figure 6A:
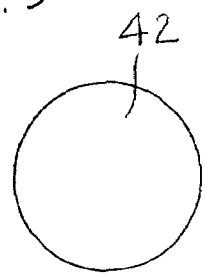
FIGS. 6A and 6B are simplified pictorial illustrations of different apertures in the movable head with the diameter selection lever in its lower and upper positions, respectively.
Figure 6B:
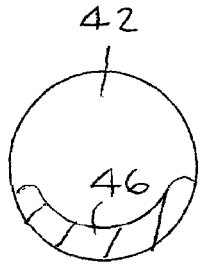

Pipe clamp fixture 10 may further include a movable head 36, which may be moved on to the pipe and locked in place on the pipe by means of a locking device 38, such as but not limited to, a clamp that tightens against the outer diameter of the pipe. Movable head 36 may include a clamping jaw 40 and a mounting aperture 42 (FIGS. 6A and 6B). A diameter selection lever 44 may be provided for controlling the diameter pipe which may be inserted in aperture 42. For example, when diameter selection lever 44 is in its lower position (FIGS. 1 and 6A), the aperture 42 may be large to accept ¾ inch diameter pipe 14. When diameter selection lever 44 is in its upper position (FIGS. 2 and 6B), it moves up a shutter 46 so as to make aperture 42 smaller to accept ½ inch diameter pipe 32.

Thus, in the present invention, by using one pipe clamp fixture, one can use a pipe of more than one size. This is achieved by simply selecting which size aperture to use in the movable head 36 and which size mounting hole to use in the stationary head 12. Thus the end user only needs to buy one set of fixtures and the retail store only needs to display and stock one item, thus lowering space and stock management. Clamping will become quicker, thus making the job more productive. This will offer more security as the clamps should be clamped properly and consistently. The materials being clamped will benefit from more controlled, consistent and repeatable clamping.

The scope of the present invention includes both combinations and subcombinations of the features described hereinabove as well as modifications and variations thereof which would occur to a person of skill in the art upon reading the foregoing description and which are not in the prior art.

What is claimed is:

1. A pipe clamp fixture comprising:

a stationary head affixable to a pipe, said stationary head comprising a clamping jaw for clamping a workpiece different from said pipe and having a first mounting hole for accepting a first diameter pipe and a second mounting hole of a different diameter than the first mounting hole for accepting a second diameter pipe wherein said second hole is linearly aligned with said first hole; and a movable head lockable in place on the pipe by means of a locking device, said movable head comprising a clamping jaw for clamping the workpiece and a mounting aperture whose diameter is controlled by a diameter selection lever so that the mounting aperture selectively accepts both the first and second diameter pipes, wherein said diameter selection lever moves a shutter, wherein in a first position of said diameter selection lever said mounting aperture is relatively large and said shutter does not substantially protrude into said mounting aperture, and in a second position of said diameter selection lever said mounting aperture is relatively small and said shutter protrudes into said mounting aperture, and wherein a cross section of said shutter perpendicular to a longitudinal axis of said pipe has a curved crescent shape.

2. The pipe clamp fixture according to claim 1, wherein said stationary head further comprises a power drive connection for turning with a tool.

3. The pipe clamp fixture according to claim 1, wherein said shutter has an arcuate edge that protrudes into said mounting aperture in said second position of said diameter selection lever.

4. A pipe clamp fixture comprising:

a stationary head affixable to a pipe, said stationary head comprising a bulkhead with a threaded hole for a threaded rod to pass through, wherein a handle is affixed to one end of said rod and a clamping jaw for clamping a workpiece different from said pipe is affixed to another end of said rod, said clamping jaw of said stationary head being affixed to a bracket with a support hole for supporting the pipe, said bulkhead having a first mounting hole on one side thereof for accepting a first diameter pipe and a second mounting hole on another side thereof of a different diameter than the first mounting hole for accepting a second diameter pipe wherein said second hole is linearly aligned with said first hole, said stationary head further comprising a power drive connection for turning with a tool; and a movable head lockable in place on the pipe by means of a locking device, said movable head comprising a clamping jaw for clamping the workpiece and a mounting aperture whose diameter is controlled by a diameter selection lever so that the mounting aperture selectively accepts both the first and second diameter pipes, wherein said diameter selection lever moves a shutter, wherein in a first position of said diameter selection lever said mounting aperture is relatively large and said shutter does not substantially protrude into said mounting aperture, and in a second position of said diameter selection lever said mounting aperture is relatively small and said shutter protrudes into said mounting aperture, and wherein a cross section of said shutter perpendicular to a longitudinal axis of said pipe has a curved crescent shape.

5. The pipe clamp fixture according to claim 4, wherein said shutter has an arcuate edge that protrudes into said mounting aperture in said second position of said diameter selection lever.

* * * * *